United States Patent [19]

Schultz

[11] Patent Number: 4,762,973

[45] Date of Patent: Aug. 9, 1988

[54] MICROWAVE OVEN WITH A HINGED COVER TO SEAL A COOKING CONTAINER

[75] Inventor: Horst Schultz, Massenheim, Fed. Rep. of Germany

[73] Assignee: Alfa Institut fur Hauswirtschafliche Produkt-und Verfahrens-Enwicklung GmbH, Fed. Rep. of Germany

[21] Appl. No.: 50,702

[22] PCT Filed: Sep. 4, 1986

[86] PCT No.: PCT/DE86/00356

§ 371 Date: Jul. 10, 1987

§ 102(e) Date: Jul. 10, 1987

[87] PCT Pub. No.: WO87/01550

PCT Pub. Date: Mar. 12, 1987

[30] Foreign Application Priority Data

Sep. 10, 1985 [DE] Fed. Rep. of Germany ..... 3532153

[51] Int. Cl.[4] ..... H05B 6/80

[52] U.S. Cl. ..... 219/10.55 E; 219/10.55 R; 219/10.55 D; 99/451; 99/DIG. 14

[58] Field of Search ..... 219/10.55 E, 10.55 F, 219/10.55 D, 10.55 R, 404, 444; 99/DIG. 14, 451, 376, 377, 379

[56] References Cited

U.S. PATENT DOCUMENTS

| | | | |
|---|---|---|---|
| 3,854,021 | 12/1974 | Moore et al. | 219/10.55 E |
| 3,935,415 | 1/1976 | Moore | 219/10.55 E |
| 3,943,319 | 3/1976 | Hirai et al. | 219/10.55 D |
| 4,364,308 | 12/1982 | John et al. | 99/351 |

FOREIGN PATENT DOCUMENTS

| | | | |
|---|---|---|---|
| 2259310 | 6/1974 | Fed. Rep. of Germany . | |
| 2265042 | 10/1975 | France . | |
| 2299840 | 9/1976 | France . | |
| 52-62748 | 5/1977 | Japan | 219/10.55 E |
| 2090510 | 7/1982 | United Kingdom . | |

*Primary Examiner*—Philip H. Leung

*Attorney, Agent, or Firm*—Breneman & Georges

[57] ABSTRACT

The invention concerns a microwave device for the preparation of food with a lower part (2) designed for holding an easily handled container (5) in the form of a pot, bowl or pan containing food, surrounding at least one part of the cooking space and independent of the basic device composed of a lower part (2), an upper part (3) fitting as a cover over the lower part (2) in operating position and a connecting column (4), joining the lower (2) and upper part (3), which in operating position rests tightly sealing against the upper part (3) surrounding the cooking space with its upper rim (6) in order to prevent the leaking of microwave emission. For easy handling, multiple uses and space saving storage of such a microwave device it is planned that the lower part (2) and upper part (3) are hinged in such a manner that by a pivoting of the lower part (2) relative to the upper part (3), the upper part (3) rests against the rim of the container (5) in its operating position and releases the container (5) for removal in its open position, whereby particularly the lower part (2) and upper part (3) are hinged in such a manner that the upper part (3) in a resting position—and with removed container—rests against or almost against the support surface for the container (5) on the lower part (2).

22 Claims, 1 Drawing Sheet

Figures 1, 2, 3:
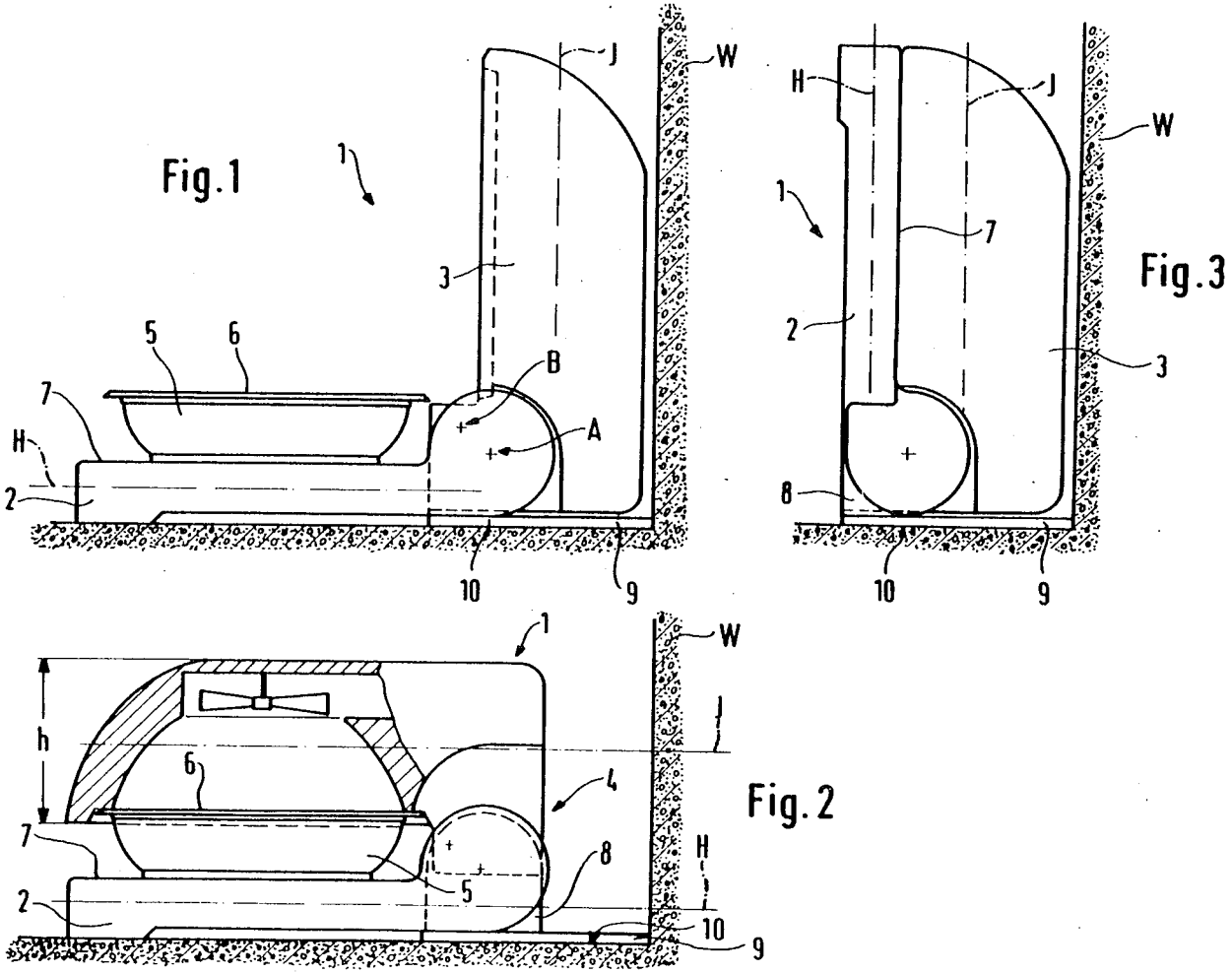

W
J
H
A
B
1
2
3
4
5
6
7
8
9
10
h

MICROWAVE OVEN WITH A HINGED COVER TO SEAL A COOKING CONTAINER

DESCRIPTION

The invention concerns a microwave device for the preparation of food with a lower part designed for holding an easily handled container in the form of a pot, bowl or pan containing food, surrounding at least one part of the cooking space and independent of the basic device composed of a lower part, an upper part fitting as a cover over the lower part in operating position and a connecting column, joining the lower and upper part, which in operating position rests tightly sealing against the upper part surrounding the cooking space with its upper rim in order to prevent the leaking of microwave emition.

Such a microwave device is known from DE-OS No. 30 34 962. There, the container is either pushed into operating position in guides on the upper part or set onto a plate of the lower part that can be raised and lowered. In both cases considerable manipulations are needed in order to get the container into operating position. In addition, the container is no longer or only with difficulty accessible from above, once it has been pushed or set into the basic device, which is a particular disadvantage if the support surface for the container in the lower part is formed by a heating plate, so that the food in the microwave device can not only be heated by microwave, but also, simultaneously or independently, heated by the heating plate, and for which purpose the inside of the container should be easily accessible.

It is the task of the current invention to construct a microwave device of the above cited type which provides simpler handling and better access to the container in its position on the support surface of the lower part.

In the microwave device of the type cited in the beginning, this problem is solved, according to the invention, essentially by the fact that the lower part and the upper part are hinged together in such a manner that, based on a relative motion by lower part and upper part into a closed operating position, the upper part rests against the rim of the container and, in the open position, releases the container for removal from the basic device. Thus, in the open position, the container is simply set onto the designated part of the support surface of the lower part.

When the foods contained in the container are supposed to be treated by microwaves, the upper part is simply flipped downward into the operating position, whereby it rests against the upper rim of the container and thus locks the cooking area against the leakage of microwaves and also against the free release of steam. Should the container have to be removed from the basic device, further additions to be added to the dish or the food have to be stirred, the upper part simply has to be flipped up so that the inside of the container is accessible and the container can also be easily removed from the basic device. The upper part remains in the open position if the support suface for the container in the lower part is formed by a heating plate and is only to be used as heating plate. In this manner the microwave device is doubly useful with easy access to the container.

The device cited in the beginning is relatively voluminous as its outer dimensions are fixed, regardless if the container is inserted into the basic device or not. For this reason it is another goal of the present invention that, in the resting position of its parts, i.e., when it is not supposed to be used, it can be stored in a space saving manner. This is attained due to a special characteristic of the invention in which the lower part and upper part are hinged in such a manner that, by a relative tilting of lower and upper part, the upper part—with removed container—will rest, or almost rest, against the lower part in the area of the support surface. Here too, use is made of the basic idea of the pivotability of the upper part against the lower part; however, care has been taken that the upper part, relative to the lower part, can be brought not only into a closed operating position in which the upper part rests against the rim of the container, but, beyond this, there is a pivoting until the upper part almost rests against the lower part in its resting position, i.e., with removed container. So that the upper part rests on a large surface against the rim of the container in its closed operating position, as well as against the lower part in its resting position, the lower part and the upper part are—in a further development of the invention—pivotable around two parallel but offset axes. One axis is located closer to the contact level in the area of the upper rim of the container when it is inserted into the basic device, and the other axis closer to the level of the support surface of the lower part for the container.

The pivoting mechanism is preferably constructed in such a way that the main levels of lower part and upper part are parallel or nearly parallel to each other in their closed positions and at a right angle to each other, or nearly so, in their open position. However, the accessibility and removability of the container from the basic device already starts at a much lesser angle. The upper part preferably should be able to assume an angle of 30 degrees, relative to the lower part, in its opened position. The parallelism in the closed positions for the purpose of good microwave sealing should preferably also be applicable when the upper part rests against the rim of the container for the operation of the microwave device, as well as for the purpose of space saving when the container has been removed from the basic device and the lower and upper parts have been pivoted to their resting position in which they are in direct contact.

The two pivoting axes are preferably located in a hinge body connecting the lower and upper parts as part of the connecting column.

In addition, it is of particular advantage if the hinge body includes a rearward extending foot, constructed as a brace, and, in a further development of this idea, the length of the brace protruding in the rear beyond the lower part is somewhat greater than the height of the upper part. By this it is possible to attain that the microwave device can be pushed close to the wall, but not so close that the upper part could no longer be flipped open to its, e.g., vertical position. To get to the closed resting position, it is then only necessary to flip the lower part around the other axis so that the microwave device in its resting position can be placed, for example, in a space saving manner, in a rear area of the work surface of the kitchen, with parallel and vertical main surfaces of lower and upper parts, and thus does not interfere with the front work surface. When the microwave device is to be put into operation again, the lower part and upper part can successively be flipped foreward into their operating position.

The brace can serve, for example, also as a stop for the upper part in its open position and, if necessary, also for the lower part in its vertical resting position.

Further goals, characteristics, advantages and applications of the current invention can be seen from the following description of an embodiment on the basis of the enclosed drawings. All described and/or pictured characteristics in themselves or in any possible combination form the object of the current invention, also independent of their combination in the claims of their references.

Shown are:

FIG. 1. schematically in a lateral view, a microwave device containing the invention, in which the upper part is in its open position and the container is inserted, FIG. 2: the microwave device according to FIG. 1, in partial cross section, whereby the upper part is flipped foreward to rest against the upper rim of the container into its closed operating position, and FIG. 3. schematically in lateral view, the microwave device according to FIG. 1, from which the container has been removed and in which the lower part has also been flipped into its vertical position to rest against the upper part (closed resting position).

The shown microwave device 1 consists of a lower part 2 and an upper part 3, which, in their rear area, are pivotable against each other around two axes A and B, parallel to the two main surfaces H and I of lower part 2 and upper part 3, and parallel and offset against each other. If the upper part 3 is in the essentially vertical open position shown in FIG. 1 (the opening angle may also be smaller, preferably not less than 30 degrees), a pot, bowl or panshaped container 5 for the foods to be prepared can be set onto the upper support surface 7 of the lower part 2. The container 5 thus can be handled independent of the basic device consisting of the lower part 2, the upper part 3 and a connecting column 4. In the open position of the upper part 3 shown in FIG. 1, the container 5 can not only be easily set onto the support surface 7, and removed from it, but its interior is also easily accessible from the front and above. When the upper part 3 is flipped closed into the operating position shown in FIG. 2, the lower part 2 and the upper part 3 which reaches over the contaier 5 in a hood-like fashion, form the remaining part of the cooking space for microwave treatment, together with the inside space of the container 5, the upper part 3 rests in a sealing manner against the parallel upper rim 6 of the container 5, so that an undesirable leak of microwaves is prevented. After the food preparation, the device can be flipped open again into the open position shown in FIG. 1. In this position the foods contained in container 5 are again accessible, and the container 5 can also be completely removed in a simple manner for, e.g., serving the food. If, which is not shown in the drawings, the support surface 7 for the container 5 of the lower part 2 is made up of a heating plate, it is possible to use the microwave devioe 1 in the open position shown in FIG. 1 without problem for ordinary cooking, using the container 5 which matches the hood-like upper part 3, or any other container, e.g., any ordinary cooking pot.

If the microwave device 1 is supposed to be stored in a space saving manner because it will not be used for a shorter or longer time, the lower part 2, in addition to the upper part 3, is flipped into a vertical closed resting position as shown in FIG. 3, after the container 5 has been removed from the device. While the pivoting of the upper part 3, relative to the lower part 2 occurs around an axis B in such a manner that the hoodlike upper part 3 largely rests against the upper part 6 of the container 5 in its closed operating position, the pivoting upward of the lower part 2 is done around axis A, which is offset against axis B at a slant to the lower rear, in such a manner that the lower part 2 gets to rest with its support surface 7 against, or almost against, the vertically placed upper part 3. Thus, the two axes A and B, located in a hinge body 8 have the effect that, in the closed resting position according to FIG. 3, the lower part 2 and upper part 3 no longer are at a distance from each other, needed for holding the container 5, but rest directly against each other.

So that there still is enough space in front of a wall W against which the microwave device 1 is placed for flipping the upper part 3 into its open vertical position in the most space saving manner possible, the hinge body 8 has a foot 10 which is lengthened in the rear as brace 9. The brace 9, protruding beyond the rear end of the lower part 2, is slightly longer than the height h of the upper part 3. In this manner, the microwave device 1 in its resting position according to FIG. 3, stands at the slightest possible distance from wall W, and thus in a space saving manner.

Overall, the invention creates an easy handling compact microwave device with multiple uses.

I claim:

1. A microwave device for the preparation of food comprising;

(a) a lower part including a support surface;

(b) a cooking container in the form of a pot, bowl or pan having an upper rim and forming a first part of a cooking and microwave containment area, said container being adapted to be set onto said support surface of said lower part; and (c) an upper part including a microwave source to direct microwave energy into said container, said upper part being pivotally connected to said lower part by a connecting piece, said upper part forming a second part of the cooking and microwave containment area and wherein said upper part is pivotable about said connecting piece whereby an upper rim of said container rests against said upper part in a manner which seals against the leakage of microwave radiation from said container when said upper part is in a closed operating position and wherein said upper part is further pivotable to a resting position substantially against said support surface.

2. The microwave device according to claim 1 wherein said lower part and upper part are pivotally connected about first and second parallel and offset axes, said first and second axes being arranged in such a manner that pivoting of said upper part from said closed operating position to said resting position said upper part rests substantially against said support surface of said lower part.

3. The microwave device according to claim 2 wherein said lower part and upper part are substantially parallel to each other when in said closed operating position and said resting position, and wherein said lower and upper part are at substantially a right angle to each other when in an open position.

4. The microwave device according to claim 3 wherein said connecting piece includes a hinged body supporting said first and second axes.

5. The microwave device according to claim 4 wherein said connecting piece further includes a foot as a brace extending from a rear face of said microwave device.

6. The microwave device according to claim 5 wherein said brace extends beyond said lower part a distance greater than said upper part when said upper and lower parts are in said resting position.

7. The microwave device according to claim 6 wherein said brace serves as a stop for said upper part when in said open position and closed position.

8. The microwave device according to claim 2 wherein said upper part is pivotable from an open position about said first axis to said closed operating position.

9. The microwave device according to claim 8 wherein said upper part is pivotable form said open position about said second axis to said resting position.

10. The microwave device of claim 1 wherein said support surface of said lower part includes a heat source.

11. A microwave device for the preparation of food comprising:

(a) a lower part including a support surface;

(b) a separate cooking container having an upper rim defining an opening and adapted to be received on said support surface; and (c) an upper part including a microwave source to provide microwave radiation to the interior of said cooking container through said opening, said upper part being pivotally connected to said lower part and adapted to seal against said upper rim of said cooking container thereby preventing the leakage of microwave radiation from the interior of said cooking container when said upper part is pivoted to a closed operating position, wherein said cooking container and upper part define a cooking and microwave containment area when said upper part is in said closed operating position.

12. The microwave device of claim 11 wherein said upper part is connected to said lower part by a connecting piece integral with said lower part by and wherein said upper part is pivotable about a first and second parallel and offset axes in said connecting piece.

13. The microwave device of claim 12 wherein said first axis is arranged whereby said upper part is pivotable about said first axis from an open position to said closed operating position.

14. The microwave device of claim 13 wherein said upper part is pivotable about said second axis from said open position to a resting position whereby said upper part is positioned substantially parallel to and against said lower part.

15. The microwave device of claim 14 wherein said cooking container is removable serving dish.

16. A microwave device for the preparation of food comprising:

(a) a lower part having a substantially flat support surface;

(b) a removable cooking container for receiving food during cooking disposed on said support surface, said container having an upper rim and a hollow interior;

(c) an upper part connected to said lower and pivotable about a first and second axis with respect said lower part, said upper part pivotable about said first axis from an open position to a closed operating position wherein said upper part is spaced from and parallel to said lower part and rests against said upper rim of said container to seal against leakage of microwave radiation;

(d) said upper part further being pivotale about said second axis from said open position to a resting position wherein said upper part rests substantially against said lower part; and (e) a microwave source disposed in said upper part to direct microwave radiation to said interior of said container.

17. The microwave device of claim 16, wherein said support surface of said lower part includes a heat source.

18. A microwave device for the preparation of food comprising:

(a) a lower part including a support surface;

(b) a cooking and serving container having an upper rim defining an opening, said container being removably received on said support surface;

(c) a connecting piece integral with said lower part;

(d) an upper part pivotally connected to said lower part by said connecting piece, said upper part pivotable about a first axis from an open position to a closed operating position and said upper part adapted to seal against said upper rim of said cooking container to prevent leakage of microwave radiation from the interior of said cooking container said upper part further pivotable about a second axis from said open position to a rest position wherein said upper part is substantially resting against and parallel to said support surface;

(e) a microwave source disposed in said upper part to direct microwave energy through said opening into said cooking and serving container.

19. The microwave device according to claim 18 wherein said connecting piece includes a brace member extending from a rear face of said microwave device.

20. The microwave device according to claim 19 wherein said brace extends beyond said upper part when said upper part is in said rest position.

21. The microwave device according to claim 19 wherein said brace is a stop for said upper part when in said open position.

22. The microwave device according to claim 18 wherein said support surface further includes a heat source to supply heat to said cooking and serving container.

* * * * *